US009336715B2

(12) United States Patent
Han

(10) Patent No.: US 9,336,715 B2
(45) Date of Patent: May 10, 2016

(54) PIXEL, DISPLAY DEVICE AND DRIVING METHOD WITH SIMULTANEOUS WRITING AND EMISSON

(71) Applicant: Samsung Display Co., Ltd., Yongin, Gyeonggi-do (KR)

(72) Inventor: Sang-Myeon Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 68 days.

(21) Appl. No.: 13/972,771

(22) Filed: Aug. 21, 2013

(65) Prior Publication Data

US 2014/0313232 A1 Oct. 23, 2014

(30) Foreign Application Priority Data

Apr. 17, 2013 (KR) ..... 10-2013-0042361

(51) Int. Cl.
*G09G 3/32* (2006.01)
*G09G 3/36* (2006.01)

(52) U.S. Cl.
CPC ..... *G09G 3/3233* (2013.01); *G09G 3/3696* (2013.01); *G09G 2300/0819* (2013.01); *G09G 2320/045* (2013.01); *G09G 2320/0626* (2013.01)

(58) Field of Classification Search
CPC ..... G09G 3/3225; G09G 3/3233; G09G 2300/08; G09G 2300/0809–2300/0819; G09G 2300/0852; G09G 2300/0876
See application file for complete search history.

(56) References Cited

U.S. PATENT DOCUMENTS 7,893,895 B2 * 2/2011 Uchino et al. ..... 345/78
2011/0084947 A1 * 4/2011 Chung et al. ..... 345/211

FOREIGN PATENT DOCUMENTS

KR 10-2012-0015075 2/2012
KR 10-2012-0065139 6/2012
KR 10-2012-0129335 11/2012

* cited by examiner

*Primary Examiner* — Liliana Cerullo
(74) *Attorney, Agent, or Firm* — Knobbe, Martens, Olson & Bear LLP

(57) ABSTRACT

A display device comprising a plurality of pixels is disclosed. In one aspect, each pixel of the display device comprises a first capacitor connected between a data line and a first node, a reference voltage transistor configured to apply a reference voltage on the first node, a driving transistor having a gate connected to a second node and configured to control a drive current flowing from a first power supply voltage to an organic light emitting diode in response to a voltage of the second node applied to the gate of the driving transistor, a light emitting transistor configured to apply the first power supply voltage to an electrode of the driving transistor in response to a light emission signal applied to a gate of the light emitting transistor, a second capacitor connected between the second node and an anode of the organic light emitting diode, and a relay transistor configured to electrically connect the first node and the second node in response to a write signal applied to a gate of the relay transistor.

29 Claims, 11 Drawing Sheets

PIXEL, DISPLAY DEVICE AND DRIVING METHOD WITH SIMULTANEOUS WRITING AND EMISSON

CROSS-REFERENCE TO RELATED APPLICATION

This application claims priority to and the benefit of Korean Patent Application No. 10-2013-0042361 filed in the Korean Intellectual Property Office on Apr. 17, 2013, the entire contents of which are incorporated herein by reference.

BACKGROUND

1. Field of the Technology

Embodiments relates generally to a display device and, and more particularly, to a pixel of the display device including an organic light emitting diode and an active matrix display device including the pixel.

2. Description of the Related Technology

Organic light emitting displays employ organic light emitting diodes (OLED). In operation, OLEDs emit light when an electric field is applied between an anode and a cathode, and the intensity of the emitted light can in turn be controlled by current and/or voltage applied to the anode and the cathode.

An OLED can be classified as a passive matrix OLED (PMOLED) or as an active matrix OLED (AMOLED), depending on the driving method employed.

Among the various types of OLEDS, AMOLED can be preferred for certain applications when considering factors such as the resolution, the contrast, and the operation speed of the OLED. A frame of an image displayed by an AMOLED includes a scanning period, during which image data is written into a pixel of an AMOLED. The frame further includes a light emission period, during which light is emitted from the pixel based on the written image data.

With the trend of increasing display panel size and resolution, the time it takes to scan, i.e., the time it takes to write image data to a pixel, becomes longer. As the scanning time increases, the ratio of the light emission period to an overall frame period decreases. To compensate for the reduced ratio, it is sometimes necessary to increase light emission luminance by increasing the power supply voltage, so that an average luminance is not degraded for the experience of a viewer. However, such an approach has downsides. For example, power consumption of the display device increases when power supply voltage is increased. Also, the driving current flowing through the pixels during light emission increases, and problems such as non-uniform luminance caused by a voltage drop across the display panel can be aggravated.

In particular, in the case where the display device displays a stereoscopic (i.e., a 3D) image, the ratio of the light emission period in one frame can be further reduced, and the aforementioned problems may become even more aggravated. For example, when the display device displays a stereoscopic image according to the NTSC (National Television System Committee) standard, the display has to display 60 frames of a left-eye image and 60 frames of a right-eye image for 1 second. Accordingly, the drive frequency of a stereoscopic image display device needs to be at least two times higher than the driving frequency of a general image display device.

Thus, there is a need for a pixel technology whose ratio of the light emission period to an overall frame time duration does not degrade with increasing size and resolution, nor when displaying a stereoscopic image.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

Embodiments have been described in an effort to provide a pixel suitable for a large-sized and high-resolution display panel and stereoscopic image display, a display device including the same, and a driving method thereof.

In one aspect, each pixel of the display device comprises a first capacitor connected between a data line and a first node, a reference voltage transistor configured to apply a reference voltage on the first node, a driving transistor having a gate connected to a second node and configured to control a drive current flowing from a first power supply voltage to an organic light emitting diode in response to a voltage of the second node applied to the gate of the driving transistor, a light emitting transistor configured to apply the first power supply voltage to an electrode of the driving transistor in response to a light emission signal applied to a gate of the light emitting transistor, a second capacitor connected between the second node and an anode of the organic light emitting diode, and a relay transistor configured to electrically connect the first node and the second node in response to a write signal applied to a gate of the relay transistor. During a light emission period, the organic light emitting diode is configured to emit an intensity of light based at least in part on a drive current flowing through the driving transistor, where the drive current of the driving transistor determined at least in part by a voltage stored in the second capacitor. In addition, during a scanning period, the relay transistor is configured to be turned off and the reference voltage transistor is configured to be turned on to apply the reference voltage on the first node, such that a data voltage is stored in the first capacitor, the data voltage determined at least in part by an amount of current flowing through the reference voltage transistor.

Each of the plurality of pixels may further comprise a reset transistor including: a gate electrode to which a reset signal is applied; one electrode connected to the data line; and the other electrode connected to the second node.

The reference voltage transistor may comprise: a gate electrode to which a scan signal is applied; one electrode connected to the reference voltage; and the other electrode connected to the first node, wherein when the plurality of pixels are simultaneously in the light emission period, the reference voltage transistor may be turned on by a scan signal having the gate-on voltage corresponding to each of the plurality of pixels.

Each of the plurality of pixels may further comprise a switching transistor including: a gate electrode to which a scan signal is applied; one electrode connected to the data line; and the other electrode connected to the first capacitor.

During the light emission period, the reference voltage transistor and the light emission transistor may be turned on by a light emission signal having the gate-on voltage, and the switching transistor may be turned on by a scan signal having the gate-on voltage corresponding to each of the plurality of pixels.

During the light emission period, the reference voltage transistor may be turned on by a sustain signal having the gate-on voltage, and the switching transistor may be turned on by a scan signal having the gate-on voltage corresponding to each of the plurality of pixels.

Each of the plurality of pixels may further comprise a switching transistor including: a gate electrode to which a scan signal is applied; one electrode connected to the data line; and the other electrode connected to the first capacitor, and during the light emission period, the reference voltage transistor may be turned on by a sustain signal having the gate-on voltage, and the switching transistor may be turned on by a scan signal having the gate-on voltage corresponding to each of the plurality of pixels.

In another aspect, a method of driving a display device includes scanning the pixels during a scanning period of a first frame. Scanning the pixels includes turning off a relay transistor where the relay transistor configured to electrically connect a first node and a second node in response to a write signal applied to a gate of the relay transistor, turning on a reference voltage transistor to apply a reference voltage to the first node, and storing a data voltage in a first capacitor connected between a data line and the first node, where the data voltage determined at least in part by an amount of current flowing through the reference voltage transistor. The method additionally includes emitting light from the pixels during a light emission period of the first frame. Emitting light from the pixels includes turning on a driving transistor, where the driving transistor has a gate connected to the second node and configured to control a drive current flowing from a first power supply voltage to an organic light emitting diode in response to a voltage of the second node applied to the gate of the driving transistor, and turning on a light emitting transistor during the light emission period by applying a light emission signal to a gate of the light emitting transistor, and allowing the organic light emitting diode to emit light whose intensity is based at least in part on a drive current of the driving transistor determined at least in part by a voltage stored in a second capacitor connected between the second node and an anode of the organic light emitting diode. Furthermore, in the method, the voltage stored in the second capacitor is equal to the voltage stored in the first capacitor in the scanning period of the frame preceding the first frame, and the scanning period and the light emission period at least temporally overlap each other.

The light emission may occur simultaneously in the plurality of pixels.

The scanning may comprise turning on the reference voltage transistor by a scan signal having the gate-on voltage corresponding to each of the plurality of pixels.

The scanning may comprise turning on the switching transistor connecting the data line and the first capacitor by a scan signal having the gate-on voltage corresponding to each of the plurality of pixels.

The scanning may further comprise turning on the reference voltage transistor by a light emission signal having the gate-on voltage for turning on the light emitting transistor.

The scanning may further comprise turning on the reference voltage transistor by a sustain signal having the gate-on voltage for determining the length of the scanning period.

The method may further comprise resetting the anode voltage of the organic light emitting diode to a low-level voltage.

The resetting may comprise: turning on the reset transistor connecting the data line and the second node to apply the sustain voltage applied to the data line to the second node; and turning on the driving transistor by the sustain voltage, turning on the light emitting transistor by a light emission signal having the gate-on voltage, and applying a first power supply voltage having the low-level to the anode of the organic light emitting diode.

The resetting may comprise: turning on the reference voltage transistor and the relay transistor to apply the reference voltage to the second node; and turning on the driving transistor by the reference voltage, turning on the light emitting transistor by a light emission signal having the gate-on voltage, and applying a first power supply voltage having the low-level to the anode of the organic light emitting diode.

The method may further comprise, after resetting the anode voltage of the organic light emitting diode, compensating the threshold voltage of the driving transistor The compensating may comprise, when the driving transistor and the light emitting transistor are turned on, changing the first power supply voltage having the low level to a high-level voltage.

The method may further comprise, after compensating the threshold voltage of the driving transistor, turning on the relay transistor, and transmitting to the second node the voltage stored in the first capacitor in the scanning period of the frame preceding the first frame.

The data transmission may further comprise turning off the reference voltage transistor, and applying a predetermined sustain voltage, which is applied to the data line, to the first capacitor.

Yet another exemplary embodiment provides a pixel including: a first capacitor including one electrode to which the voltage of a data line is applied and the other electrode connected to a first node; a reference voltage transistor including a gate electrode to which a first control signal is applied, one electrode connected to a reference voltage, and the other electrode connected to the first node; a relay transistor including a gate electrode to which a write signal is applied, one electrode connected to the first node, and the other electrode connected to a second node; a driving transistor including a gate electrode connected to the second node, one electrode to which a first power supply voltage is applied, and the other electrode connected to a third node; a light emitting transistor including a gate electrode to which a light emission signal is applied, one electrode connected to the first power supply voltage, and the other electrode connected to one electrode of the driving transistor; a second capacitor including one electrode connected to the second node and the other electrode connected to the third node; and an organic light emitting diode including an anode connected to the third node and a cathode connected to a second power supply voltage.

The pixel may further comprise a reset transistor including a gate electrode to which a reset signal is applied, one electrode connected to the data line, and the other electrode connected to the second node.

The first control signal may be a scan signal that is sequentially applied to a display unit including a plurality of pixel.

The pixel may further comprise a switching transistor including a gate electrode to which a scan signal is applied, one electrode connected to the data line, and the other electrode connected to one electrode of the first capacitor.

The first control signal may be a light emission signal.

The first control signal may be a sustain signal for determining the length of the scanning period during which the data voltage applied to the data line is stored in the first capacitor.

At least one of the reference voltage transistor, the relay transistor, the driving transistor, the light emitting transistor, the reset transistor, and the switching transistor may be an oxide thin film transistor.

The pixel may further comprise a switching transistor including a gate electrode to which a scan signal is applied, one electrode connected to the data line, and the other electrode connected to one electrode of the first capacitor.

The first control signal may be a sustain signal for determining the length of the scanning period during which the data voltage applied to the data line is stored in the first capacitor.

The proposed pixel is configured to secure a sufficient light emission period in one frame. Moreover, the proposed pixel contributes to a large-sized and high-resolution display panel and stereoscopic image display.

DETAILED DESCRIPTION OF CERTAIN INVENTIVE EMBODIMENTS

Figure 1:
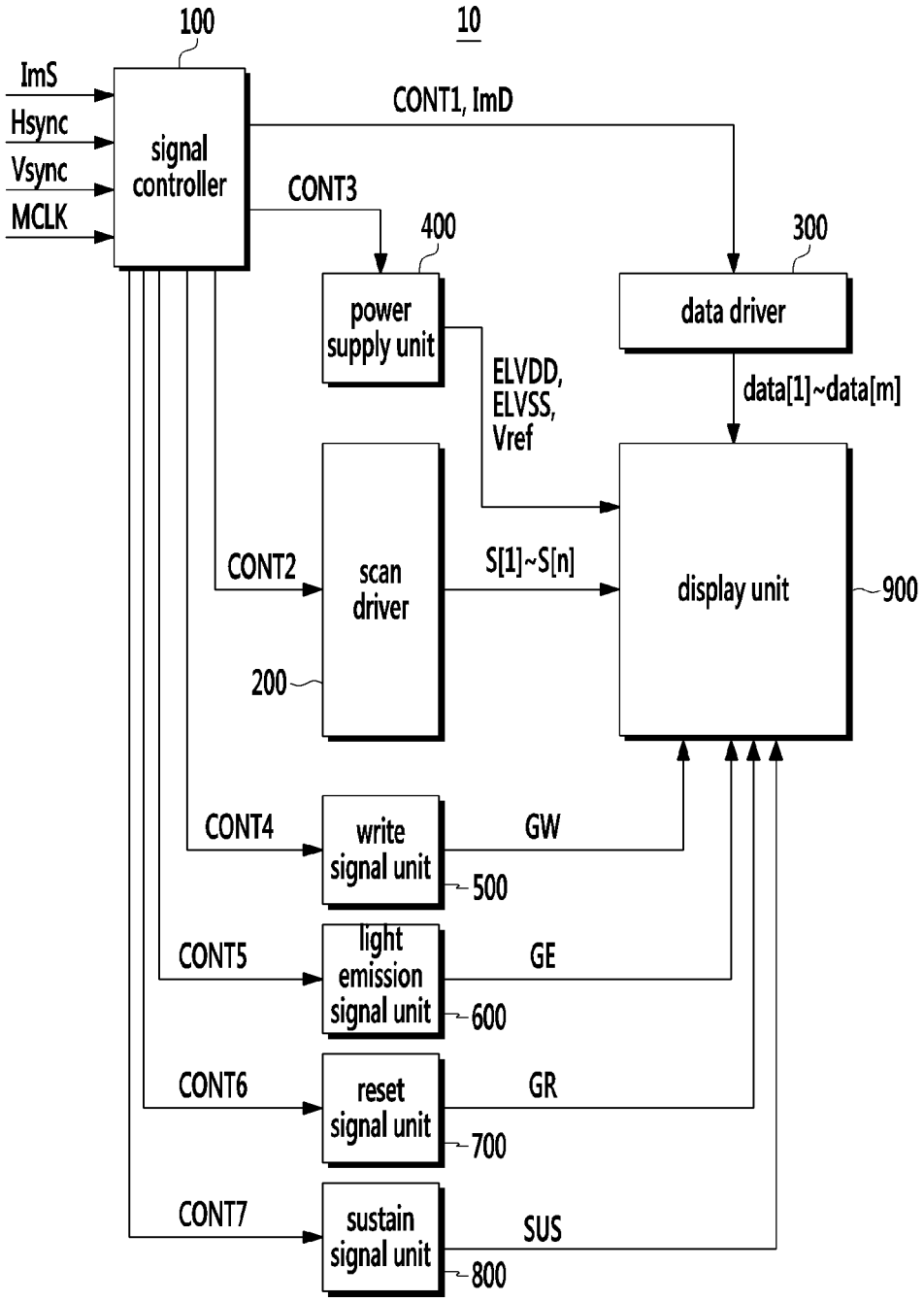
FIG. 1 is a block diagram showing a display device in accordance with an exemplary embodiment.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, like reference numerals designate like elements in several exemplary embodiments and are representatively described in the first exemplary embodiment, and different elements from those of the first exemplary embodiment will be described in other exemplary embodiments.

To clearly describe the present invention, parts not related to the description are omitted, and like reference numerals designate like components throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram showing a display device in accordance with an exemplary embodiment.

Referring to FIG. 1, a display device 10 comprises a signal controller 100, a scan driver 200, a data driver 300, a power supply unit 400, a write signal unit 500, a light emission signal unit 600, and a display unit 900. The display device 10 may further comprise at least one of a reset signal unit 700 and a sustain signal unit 800.

The signal controller 100 receives an image signal ImS and a synchronization signal input from an external device. The input image signal ImS contains luminance information of a plurality of pixels. The luminance has a predetermined number of, for example, $1024=2^{10}$, $256=2^{8}$, or $64=2^{6}$ gray levels. The synchronization signal comprises a horizontal synchronization signal Hsync, a vertical synchronization signal Vsync, and a main clock signal MCLK.

The signal controller 100 generates first to fifth driving control signals CONT1, CONT2, CONT3, CONT4, and CONT5 and an image data signal ImD in response to the image signal ImS, horizontal synchronization signal Hsync, vertical synchronization signal Vsync, and main clock signal MCLK. The signal controller 100 may further generate at least one of a sixth driving control signal CONT6 and a seventh driving control signal CONT7.

The signal controller 100 generates an image data signal ImD by dividing the image signal ImS into frames according to the vertical synchronization signal Vsync, and dividing the image signal ImS into scan lines according to the horizontal synchronization signal Hsync. The signal controller 100 transmits the image data signal ImD, along with the first driving control signal CONT1, to the data driver 300.

The display unit 900 is a display area including a plurality of pixels. The display unit 900 is configured such that a plurality of scan lines extending substantially in a row direction and almost parallel to each other to each other and a plurality of data lines extending substantially in a column direction and almost parallel to each other are connected to the plurality of pixels. Also, the display unit 900 is configured such that a plurality of power supply lines, a plurality of write signal lines, and a plurality of light emission signal lines are connected to the plurality of pixels. The display unit 900 may be configured such that at least either a plurality of reset signal lines or a plurality of sustain signal lines are connected to the plurality of pixels. The plurality of pixels may be arranged substantially in a matrix.

The scan driver 200 is connected to the plurality of scan lines, and generates a plurality of scan signals S[1] to S[n] according to the second driving control signal CONT2. The scan driver 200 may sequentially apply the scan signals S[1] to S[n] having a gate-on voltage to the plurality of scan lines.

The data driver 300 is connected to a plurality of data lines, samples and holds the input image data ImD according to the first driving control signal CONT1, and transmits a plurality of data signals data[1] to data[m] to the plurality of data lines. The data driver 300 applies the data signals data[1] to data[m] having a predetermined voltage range to the plurality of data lines, corresponding to the scan signals S[1] to S[n] having the gate-on voltage.

The power supply unit 400 is connected to the plurality of power supply lines, and adjusts the power level of a first power supply voltage ELVDD and a second power supply voltage ELVSS according to the third driving control signal CONT3. The power supply unit 400 may supply a reference voltage Vref to the plurality of pixels.

The write signal unit 500 is connected to the plurality of write signal lines, and generates a write signal GW according to the fourth driving control signal CONT4. The write signal unit 500 may simultaneously apply the write signal GW having the gate-on voltage to the plurality of pixels.

The light emission signal unit 600 is connected to the plurality of light emission signal lines, and generates a light emission signal GE according to the fifth driving signal CONT5. The light emission signal unit 600 may simultaneously apply the light emission signal GE having the gate-on voltage to the plurality of pixels.

The reset signal unit 700 is connected to the plurality of reset signal lines, and generates a reset signal GR according to the sixth driving control signal CONT6. The reset signal unit 700 may simultaneously apply the reset-signal having the gate-on voltage to the plurality of pixels.

The sustain signal unit 800 is connected to the plurality of sustain signal lines, and generates a sustain signal SUS according to the seventh driving control signal CONT7. The sustain signal unit 800 may simultaneously apply the sustain signal SUS having the gate-on voltage to the plurality of pixels.

Figure 2:
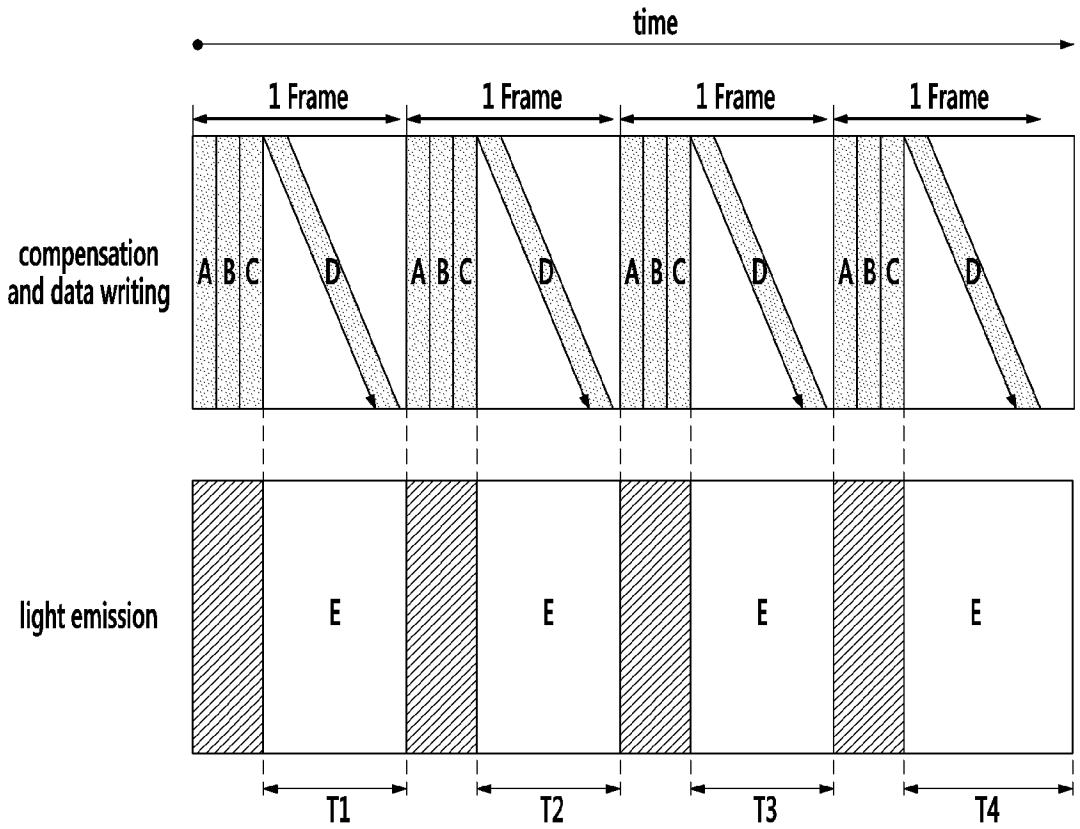
FIG. 2 is a view showing a driving scheme of a display device in accordance with an exemplary embodiment.

FIG. 2 is a view showing a driving scheme of a display device in accordance with an exemplary embodiment.

Referring to FIG. 2, one frame period during which a single image is displayed on the display unit 900 comprises a reset period A for resetting the driving voltage of the organic light emitting diode of a pixel, a compensation period B for compensating the threshold voltage of the driving transistor of a pixel, a data transmission period C for transmitting a data voltage written onto the pixel in the previous frame to the driving transistor, a scanning period D for writing data in each of a plurality of pixels, and a light emission period E for allowing the plurality of pixels to emit light corresponding to the written data. The scanning period D and the light emission period E temporally overlap each other.

During the light emission period E of the current frame, the pixels emit light according to data written in the scanning period D of the previous frame. The pixels emit light during the light emission period E of the next frame, according to data written onto the pixels in the scanning period D of the current frame.

For example, it is assumed that the scanning period D and light emission period E of an Nth frame are included in a period T1. Data written onto the pixels in the scanning period D of the period T1 is data of the Nth frame. During the light emission period E of the period T1, the pixels emit light according to data of an (N−1)th frame written in the scanning period D of the (N−1)th frame.

A period T2 comprises the scanning period D and light emission period E of an (N+1)th frame. Data written onto the pixels in the scanning period D of the period T2 is data of the (N+1)th frame. During the light emission period E of the period T2, the pixels emit light according to data of the Nth frame written in the scanning period D of the Nth frame, that is, in the period T1.

A period T3 comprises the scanning period D and light emission period E of an (N+2)th frame. Data written onto the pixels in the scanning period D of the period T3 is data of the (N+2)th frame. During the light emission period E of the period T3, the pixels emit light according to data of the (N+1)th frame written in the scanning period D of the (N+1)th frame, that is, in the period T2.

A period T4 comprises the scanning period D and light emission period E of an (N+3)th frame. Data written onto the pixels in the scanning period D of the period T4 is data of the (N+3)th frame. During the light emission period E of the period T4, the pixels emit light according to data of the (N+2)th frame written in the scanning period D of the (N+2)th frame, that is, in the period T3.

A description will be made, referring to FIG. 3, with respect to a pixel structure in which data of the current frame is written in a scanning period D and light is emitted according to data of the previous frame in a light emission period E overlapping the scanning period D.

Figure 3:
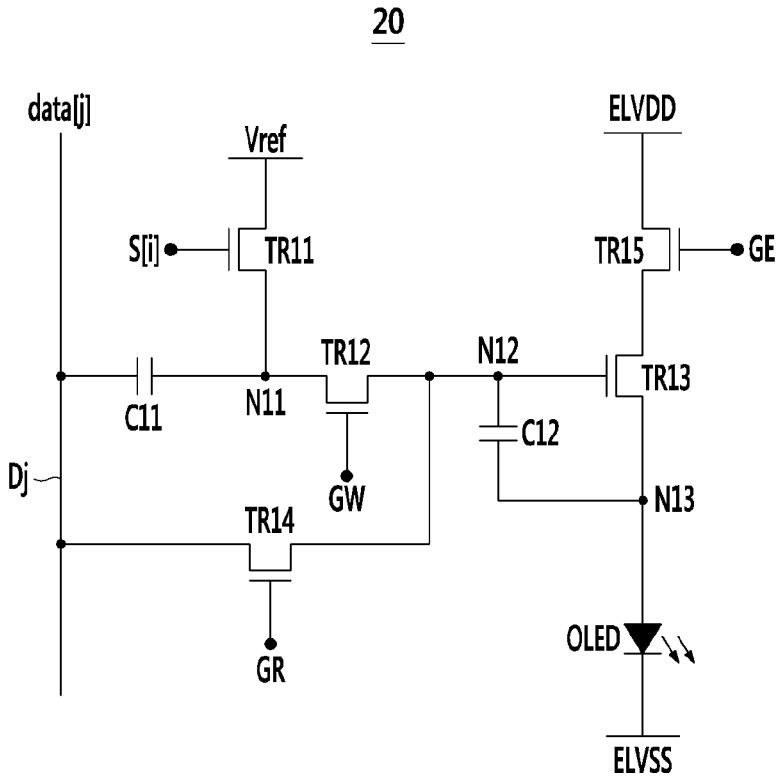
FIG. 3 is a circuit diagram showing a pixel in accordance with an exemplary embodiment.

FIG. 3 is a circuit diagram showing a pixel in accordance with an exemplary embodiment.

Referring to FIG. 3, a pixel 20 in accordance with a first exemplary embodiment comprises a reference voltage transistor TR11, a relay transistor TR12, a driving transistor TR13, a reset transistor TR14, a light emitting transistor TR15, a first capacitor C11, a second capacitor C12, and an organic light emitting diode OLED.

The reference voltage transistor TR11 comprises a gate electrode to which a scan signal S[i] is applied, one electrode connected to a reference voltage Vref, and the other electrode connected to a first node N11. The reference voltage transistor TR11 is turned on by the scan signal S[i] having a gate-on voltage to apply the reference voltage Vref to the first node N11.

The relay transistor TR12 comprises a gate electrode to which a write signal GW is applied, one electrode connected to the first node N11, and the other electrode connected to a second node N12. The relay transistor TR12 is turned on by the write signal GW having the gate-on voltage to apply the voltage of the first node N11 to the second node N12.

The driving transistor TR13 comprises a gate electrode connected to the second node N12, one electrode connected to the other electrode of the light emitting transistor TR15, and the other electrode connected to a third node N13. The driving transistor TR13 is switched on and off by the voltage of the second node N12 to control the drive current supplied to the organic light emitting diode OLED.

The reset transistor TR14 comprises a gate electrode to which a reset signal GR is applied, one electrode connected to a data line Dj, and the other electrode connected to the second node N12. The reset transistor TR14 is turned on by the reset signal GR having the gate-on voltage to apply the voltage applied to the data line Dj to the second node N12.

The light emitting transistor TR15 comprises a gate electrode to which a light emission signal GE is applied, one electrode connected to the first power supply voltage ELVDD, and the other electrode connected to one electrode of the driving transistor TR13.

The first capacitor C11 comprises one electrode connected to the data line Dj and the other electrode connected to the first node N11.

The second capacitor C12 comprises one electrode connected to the second node N12 and the other electrode connected to the third node N13.

The organic light emitting diode OLED comprises an anode connected to the third node N13 and a cathode connected to a second power supply voltage ELVSS. The organic light emitting diode OLED may give off light of one of primary colors. Examples of the primary colors may comprise three primary colors: red, green, and blue, and a desired color may be displayed by a spatial or temporal sum of these three primary colors.

In some embodiments, the reference voltage transistor TR11, the relay transistor TR12, the driving transistor TR13, the reset transistor TR14, and the light emitting transistor TR15 may be n-channel field effect transistors. The gate-on voltage for turning on the reference voltage transistor TR11, the relay transistor TR12, the driving transistor TR13, the reset transistor TR14, and the light emitting transistor TR15 is a high-level voltage, and the gate-off voltage for turning them off is a low-level voltage.

Although the reference voltage transistor TR11, the relay transistor TR12, the driving transistor TR13, the reset transistor TR14, and the light emitting transistor TR15 are illustrated as n-channel field effect transistors, in other embodiments, at least one of them may be a p-channel field effect transistor. The gate-on voltage for turning on the p-channel field effect transistor is a low-level voltage, and the gate-off voltage for turning it off is a high-level voltage.

Figure 4:
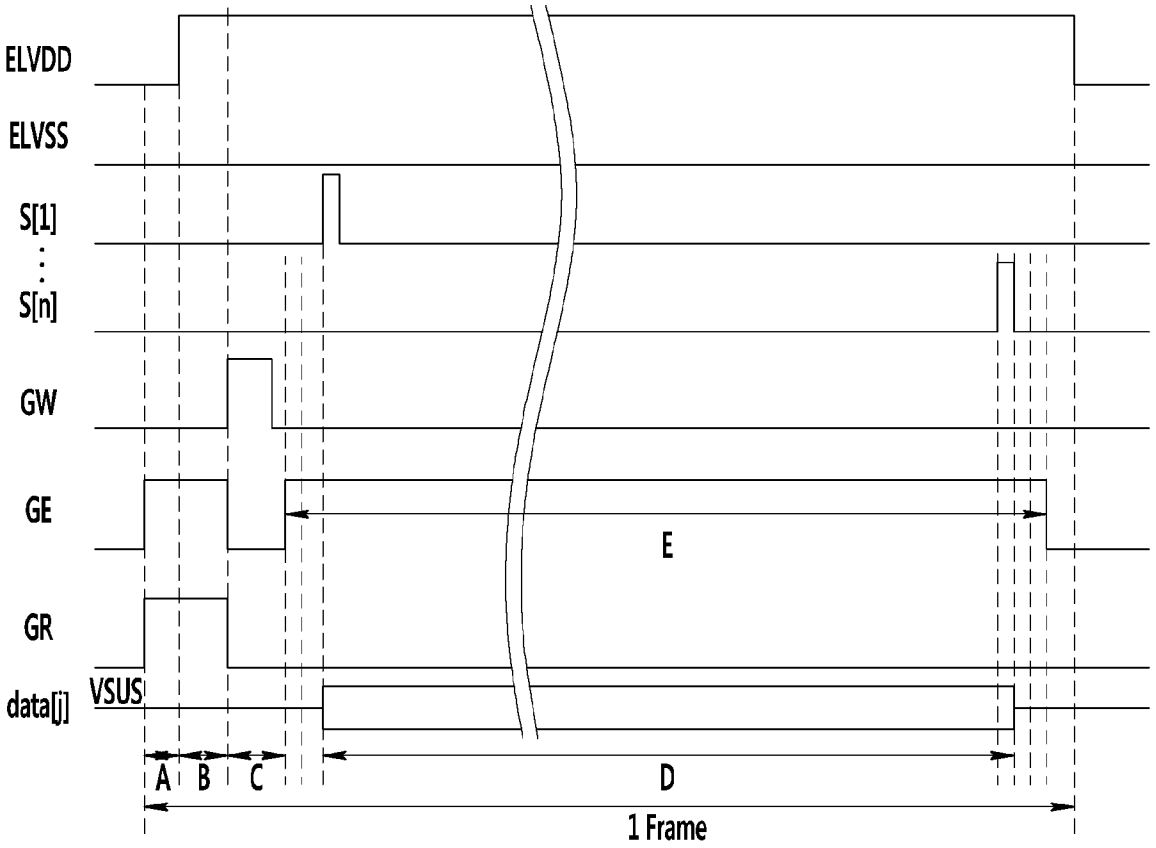
FIG. 4 is a timing diagram showing a driving method of a display device in accordance with an exemplary embodiment.

FIG. 4 is a timing diagram showing a driving method of a display device in accordance with an exemplary embodiment.

Referring to FIGS. 3 and 4, a driving method of a display device 10 including the pixel 20 of the first exemplary embodiment will be described. The display device including the pixel 20 of the first exemplary embodiment may not comprise the sustain signal unit 800.

During the reset period A, the first power supply voltage ELVDD and the second power supply voltage ELVSS are applied as a low-level voltage, the light emission signal GE and the reset signal GR are applied with the gate-on voltage, the scan signals S[1] to S[n] and the write signal GW are applied with the gate-off voltage, and the data signal data[j] is applied with a sustain voltage VSUS. The light emitting transistor TR15 is turned on by the light emission signal GE having the gate-on voltage, and the reset transistor TR14 is turned on by the reset signal GR having the gate-on voltage. The sustain voltage VSUS is applied to the second node N12 through the turned-on reset transistor TR14. The sustain voltage VSUS may be a predetermined voltage enough to turn on the driving transistor TR13, and the driving transistor TR13 is turned on by the sustain voltage VSUS. The first power supply voltage ELVDD of the low level is applied to the third node N13 through the turned-on driving transistor TR13 and the light emitting transistor TR15. Accordingly, the voltage of the third node N13, i.e., the anode voltage of the organic light emitting diode OLED, is reset to the low-level voltage. The voltages at both ends of the second capacitor C12 are reset to the sustain voltage VSUS of the second node N12 and the low-level voltage of the third node N13.

During the compensation period B, the first power supply voltage ELVDD is changed to a high-level voltage. As the first power supply voltage ELVDD is changed to a high-level voltage, current flows through the turned-on driving transistor TR13 and the light emitting transistor TR15. The voltage of the third node N13 reset to the low-level voltage gradually rises, and the driving transistor TR13 is turned off when the voltage of the third node N13 reaches a VSUS−Vth voltage. Here, Vth denotes the threshold voltage of the driving transistor TR13. The threshold voltage Vth of the driving transistor TR13 is stored in the second capacitor C12.

During the data transmission period C, the first power supply voltage ELVDD is applied as a high-level voltage, the second power supply voltage ELVSS is applied as a low-level voltage, the write signal GW is applied with the gate-on voltage, the scan signals S[1] to S[n], the light emission signal GE, and the reset signal GR are applied with the gate-off voltage, and the data signal data[j] is applied with the sustain voltage VSUS. The light emitting transistor TR15 is turned off by the light emission signal GE having the gate-off voltage, and the reset transistor TR14 is turned off by the reset signal GR having the gate-off voltage. The relay transistor TR12 is turned on by the write signal GW having the gate-on voltage. As the relay transistor TR12 is turned on, the voltage stored in the first capacitor C11 is applied to the second node N12. The voltage stored in the first capacitor C11, which is stored in the first capacitor C11 in the scanning period D of the previous frame, is denoted by Vref−data. A description of which will be given later in the description of the scanning period D. Here, data denotes the voltage of data signals data [1] to data[m]. In this case, as the sustain voltage VSUS is applied to the data line Dj, a Vref−data+VSUS voltage is applied to the second node N12. The voltage Vg of the second node N12 is changed from VSUS by the amount of Vref−data+VSUS.

In this case, as the second capacitor C12 and the parasitic capacitor of the organic light emitting diode OLED are serially connected, the serially-connected capacitors affect the amount of voltage change of Vref−data+VSUS.

The voltage Vg of the second node N12 is changed as shown in Equation 1.

$$\begin{aligned} Vg &= VSUS + (Vref - \text{data} + VSUS - VSUS) \times \alpha \\ &= VSUS + (Vref - \text{data}) \times \alpha \\ \alpha &= Chold / (Chold + Cx) \\ Cx &= (Coled \times Cst) / (Coled + Cst) \end{aligned} \quad \text{(Equation 1)}$$

where Chold denotes the capacitance of the first capacitor C11, Cst denotes the capacitance of the second capacitor C12, and Coled denotes the parasitic capacitance of the organic light emitting diode OLED.

The voltage Vs of the third node N13 is changed from VSUS−Vth by the amount of voltage change at the second node N12, as shown in Equation 2.

$$Vs = VSUS - Vth + (Vref - \text{data}) \times \alpha \times (Cst/(Cst + Coled)) \quad \text{(Equation 2)}$$

During the light emission period E, the light emission signal GE is applied with the gate-on voltage, and the write signal GW is applied with the gate-off voltage. The light emitting transistor TR15 is turned on by the light emission signal GE having the gate-on voltage, and drive current Ioled flows to the organic light emitting diode OLED through the driving transistor TR13. The drive current Ioled flowing to the organic light emitting diode OLED is represented as shown in Equation 3.

$$\begin{aligned} Ioled &= k(Vgs - Vth)^2 \\ &= k[(VSUS + (Vref - \text{data}) \times \alpha) - (VSUS - Vth + (Vref - \text{data}) \times \alpha \times (Cst / (Cst + Coled))) - Vth]^2 \\ &= k[\alpha(Vref - \text{data})(1 - Cst / (Cst + Coled))]^2 \end{aligned} \quad \text{(Equation 3)}$$

where k is a parameter determined by the characteristics of the driving transistor TR13.

As such, the organic light emitting diode OLED emits light with a brightness corresponding to the drive current Ioled flowing through the driving transistor TR13 by the voltage stored in the second capacitor C12. The organic light emitting diode OLED emits light with a brightness corresponding to the data voltage, regardless of a voltage drop in the first power supply voltage ELVDD and the threshold voltage Vth of the driving transistor TR13. When the light emission signal GE is applied with the gate-off voltage, the light emission period E is finished.

During the scanning period D, the plurality of scan signals S[1 ] to S[n] are sequentially applied with the gate-on voltage, and the data signal data[j] is applied corresponding to the plurality of scan signals S[1] to S[n]. In this case, the write signal GW is applied with the gate-off voltage to turn off the relay transistor TR12. The reference voltage transistor TR11 is turned on by the scan signal S[i] having the gate-on voltage, and the reference voltage Vref is applied to the first node N11 through the turned-on reference voltage transistor TR11. If the data voltage is transmitted to the data line Dj while the reference voltage Vref is being transmitted to the first node N11, a Vref−data voltage is stored in the first capacitor C11. If the reference voltage transistor TR15 is turned off after the Vref-data voltage is stored in the first capacitor C11, the first node N11 becomes floating, and the Vref−data voltage stored in the first capacitor C11 is maintained even if the voltage of the data line Dj is changed. The Vref−data voltage stored in the first capacitor C11 is used during the light emission period E of the next frame.

As described above, the display device 10 including the pixel 20 of the first exemplary embodiment can secure sufficient data writing time because it is capable of writing data and emitting light simultaneously. Also, an operation of transmitting a data voltage to the gate electrode of the driving transistor TR13 during the data transmission period C is performed on the basis of data lines having equivalent resistance and capable of independent potential supply, thereby making it easy to achieve a stable and uniform screen display.

Figure 5:
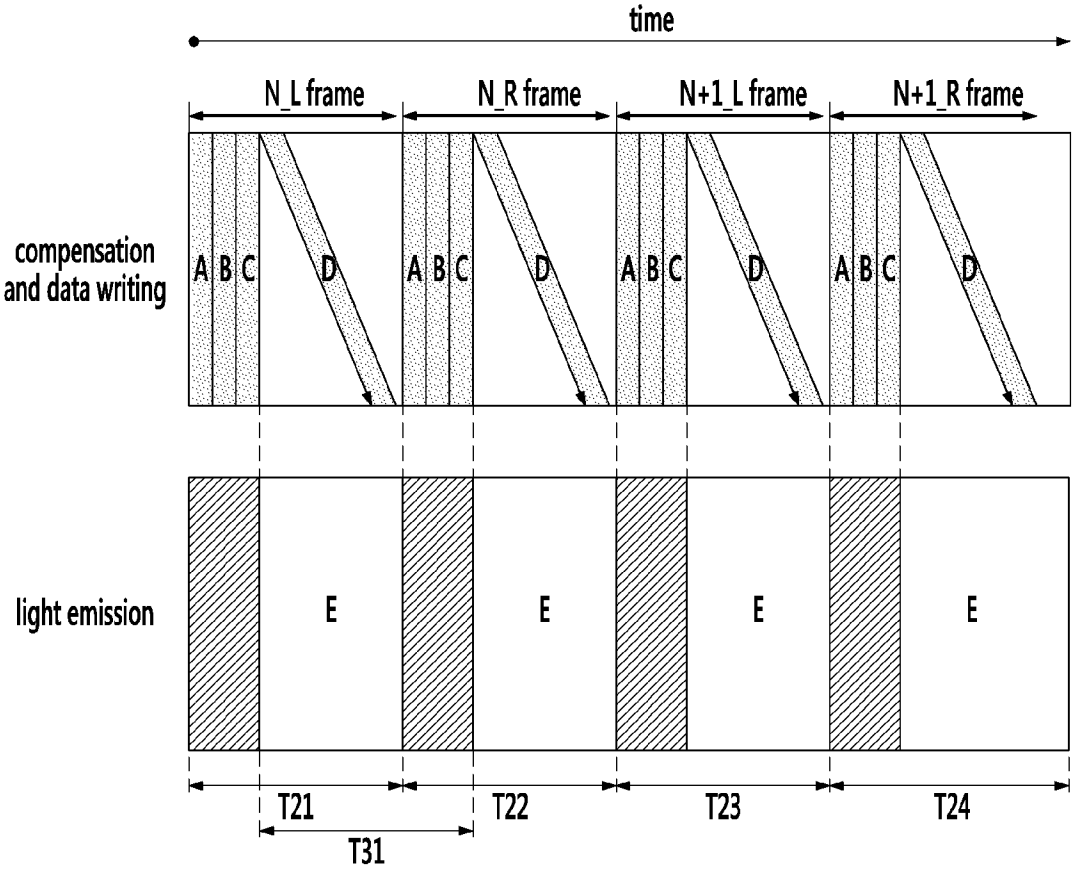
FIG. 5 is a view showing a driving scheme of a display device in accordance with another exemplary embodiment.

FIG. 5 is a view showing a driving scheme of a display device in accordance with another exemplary embodiment.

Referring to FIG. 5, the display device 10 displays a left-eye image and a right-eye image according to a shutter glass method. As shown in FIG. 5, each frame comprises a reset period A, a compensation period B, a data transmission period C, a scanning period D, and a light emission period E.

A frame in which a plurality of data signals (hereinafter referred to as left-eye image data signals) representing the left-eye image are respectively written onto a plurality of pixels is indicated by a reference numeral "L", and a frame in which a plurality of data signals (hereinafter referred to as right-eye image data signals) representing the right-eye image are respectively written onto the plurality of pixels is indicated by a reference numeral "R".

The waveforms of the reset signal GR, write signal GW, light emission signal GE, scan signals S[1] to S[n], and data signal data[j] in each of the reset period A, compensation period B, data transmission period C, scanning period D, and light emission period E are identical to the waveforms shown in FIG. 4. Thus, the description of each period is omitted.

The left-eye image data signals of the N_L frame are written onto the plurality of pixels during the scanning period D of the period T21. During the scanning period D, the left-eye image data signals corresponding to the plurality of pixels are written. Hereupon, the plurality of pixels emit light according to the right-eye image data signals written in the scanning period D of the N−1_R frame during the light emission period E of the period T21.

The right-eye image data signals of the N_R frame are written onto the plurality of pixels during the scanning period D of the period T22. During the scanning period D, the right-eye image data signals corresponding to the plurality of pixels are written. Hereupon, the plurality of pixels emit light according to the left-eye image data signals written in the scanning period D of the N_L frame during the light emission period E of the period T22.

The left-eye image data signals of the N+1_L frame are written onto the plurality of pixels during the scanning period D of the period T23. During the scanning period D, the left-eye image data signals corresponding to the plurality of pixels are written. Hereupon, the plurality of pixels emit light according to the right-eye image data signals written in the scanning period D of the N_R frame during the light emission period E of the period T23.

The right-eye image data signals of the N+1_R frame are written onto the plurality of pixels during the scanning period D of the period T24. During the scanning period D, the right-eye image data signals corresponding to the plurality of pixels are written. Hereupon, the plurality of pixels emit light according to the left-eye image data signals written in the scanning period D of the N+1_L frame during the light emission period E of the period T24.

In this manner, the right-eye image is luminous simultaneously while the left-eye image is being written, and the left-eye image is luminous simultaneously while the right-eye image is being written. Thus, a sufficient light emission period can be obtained, and thereby the picture quality of stereoscopic images is improved.

Since the scanning period D and the light emission period E are included in the same period, the interval T31 between the light emission period E of each frame may be set regardless of the scanning period. Here, the interval T31 between the light emitting periods E may be set as an interval optimized for the liquid response speed of shutter glasses.

In a conventional case in which the scanning period D and the light emission period E are not included in the same period, the light emission period E comes next to the scanning period D. Thus, one frame has a small time margin for setting the light emission period E. In the proposed driving scheme, the light emission period E may be set in the remaining period of one frame, except the rest period A, compensation period b, and data transmission period C. Accordingly, the time margin for setting the light emission period E is increased compared to the conventional case, and thereby the interval T31 between the light emission periods E may be set in consideration of the liquid crystal response speed of the shutter glasses.

For example, the interval T31 between the light emission periods E may be se, considering the time taken for the right-eye lens (or the left-eye lens) of the shutter glasses to be fully opened after the light emission of the left-eye image (or the right-eye image) is finished.

Figure 6:
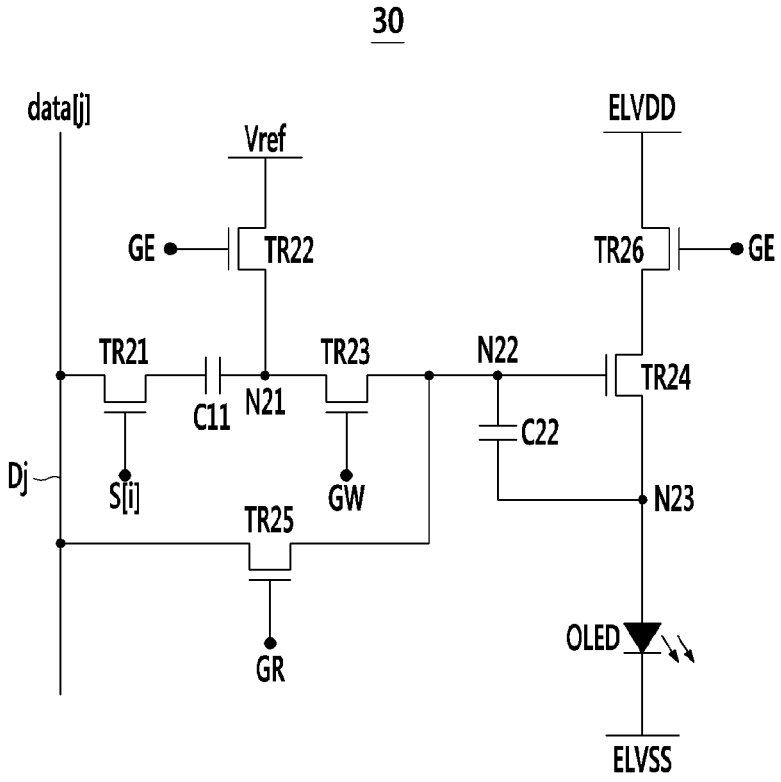
FIG. 6 is a circuit diagram showing a pixel in accordance with another exemplary embodiment.

FIG. 6 is a circuit diagram showing a pixel in accordance with another exemplary embodiment.

Referring to FIG. 6, a pixel 30 of the second exemplary embodiment comprises a switching transistor TR21, a reference voltage transistor TR22, a relay transistor TR23, a driving transistor TR24, a reset transistor TR25, a light emitting transistor TR26, a first capacitor C21, a second capacitor C22, and an organic light emitting diode OLED.

The switching transistor TR21 comprises a gate electrode to which a scan signal S[i] is applied, one electrode connected to a data line Dj, and the other electrode connected to one electrode of the first capacitor C21. The switching transistor TR21 is turned on by the scan signal S[i] having a gate-on voltage to apply the voltage applied to the data line Dj to the first capacitor C21.

The reference voltage transistor TR22 comprises a gate electrode to which a light emission signal GE is applied, one electrode connected to a reference voltage Vref, and the other electrode connected to a first node N21. The reference voltage transistor TR22 is turned on by the light emission signal GE having the gate-on voltage to apply the reference voltage Vref to the first node N21.

The relay transistor TR23 comprises a gate electrode to which a write signal GW is applied, one electrode connected to the first node N21, and the other electrode connected to a second node N22. The relay transistor TR23 is turned on by the write signal GW having the gate-on voltage to apply the voltage of the first node N21 to the second node N22.

The driving transistor TR24 comprises a gate electrode connected to the second node N22, one electrode connected to the other electrode of the light emitting transistor TR26, and the other electrode connected to a third node N23. The driving transistor TR24 is switched on and off by the voltage of the second node N22 to control the drive current supplied to the organic light emitting diode OLED.

The reset transistor TR25 comprises a gate electrode to which a reset signal GR is applied, one electrode connected to the data line Dj, and the other electrode connected to the second node N22. The reset transistor TR25 is turned on by the reset signal GR having the gate-on voltage to apply the voltage applied to the data line Dj to the second node N22.

The light emitting transistor TR26 comprises a gate electrode to which a light emission signal GE is applied, one electrode connected to a first power supply voltage ELVDD, and the other electrode connected to one electrode of the driving transistor TR24.

The first capacitor C21 comprises one electrode connected to the other electrode of the switching transistor TR21 and the other electrode connected to the first node N21.

The second capacitor C22 comprises one electrode connected to the second node N22 and the other electrode connected to the third node N23.

The organic light emitting diode OLED comprises an anode connected to the third node N23 and a cathode connected to a second power supply voltage ELVSS. The organic light emitting diode OLED may give off light of one of primary colors. Examples of the primary colors may comprise three primary colors: red, green, and blue, and a desired color may be displayed by a spatial or temporal sum of these three primary colors.

The pixel 30 of the second exemplary embodiment is different from the pixel 20 of the first exemplary embodiment in that it further comprises a switching transistor TR21. Also, while the scan signal S[i] is applied to the gate electrode of the reference voltage transistor TR11 of the pixel 20 of the first exemplary embodiment, the light emission signal GE is applied to the gate electrode of the reference voltage transistor TR22 of the pixel 30 of the second exemplary embodiment.

The switching transistor TR21, the reference voltage transistor TR22, the relay transistor TR23, the driving transistor TR24, the reset transistor TR25, and the light emitting transistor TR26 may be n-channel field effect transistors. The gate-on voltage for turning on the switching transistor TR21, the reference voltage transistor TR22, the relay transistor TR23, the driving transistor TR24, the reset transistor TR25, and the light emitting transistor TR26 is a high-level voltage, and the gate-off voltage for turning them off is a low-level voltage.

Although the switching transistor TR21, the reference voltage transistor TR22, the relay transistor TR23, the driving transistor TR24, the reset transistor TR25, and the light emitting transistor TR26 are illustrated as n-channel field effect transistors, at least one of them may be a p-channel field effect transistor. The gate-on voltage for turning on the p-channel field effect transistor is a low-level voltage, and the gate-off voltage for turning it off is a high-level voltage.

Figure 7:
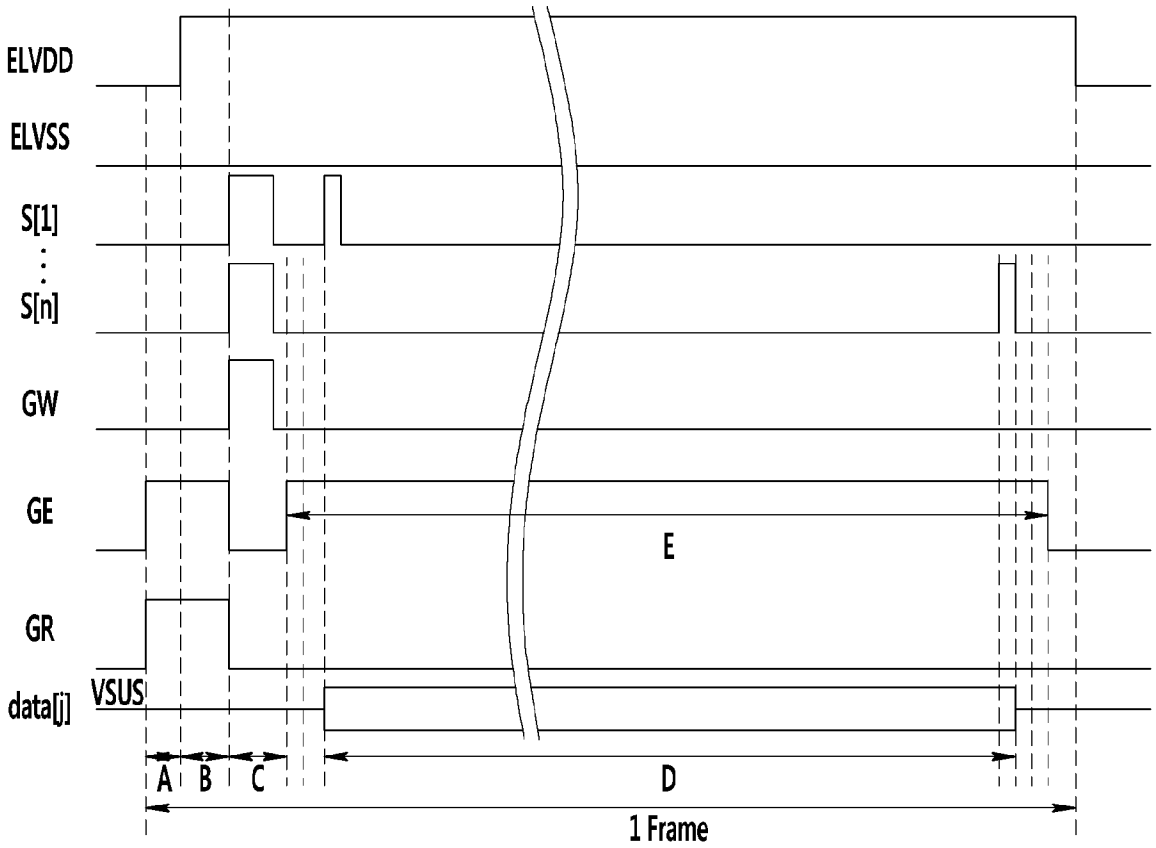
FIG. 7 is a timing diagram showing a driving method of a display device in accordance with another exemplary embodiment.

FIG. 7 is a timing diagram showing a driving method of a display device in accordance with another exemplary embodiment.

Referring to FIGS. 6 and 7, a driving method of a display device including the pixel 30 of the second exemplary embodiment will be described. The display device including the pixel 30 of the second exemplary embodiment may not comprise the sustain signal unit 800.

During the reset period A, the first power supply voltage ELVDD and the second power supply voltage ELVSS are applied as a low-level voltage, the light emission signal GE and the reset signal GR are applied with the gate-on voltage, the scan signals S[1] to S[n] and the write signal GW are applied with the gate-off voltage, and the data signal data[j] is applied with a sustain voltage VSUS. The light emitting transistor TR26 is turned on by the light emission signal GE having the gate-on voltage, and the reset transistor TR25 is turned on by the reset signal GR having the gate-on voltage. The sustain voltage VSUS is applied to the second node N22 through the turned-on reset transistor TR25. The sustain voltage VSUS may be a predetermined voltage enough to turn on the driving transistor TR24, and the driving transistor TR24 is turned on by the sustain voltage VSUS. The first power supply voltage ELVDD of the low level is applied to the third node N23 through the turned-on driving transistor TR24 and the light emitting transistor TR26. Accordingly, the voltage of the third node N23, i.e., the anode voltage of the organic light emitting diode OLED, is reset to the low-level voltage. The voltages at both ends of the second capacitor C22 are reset to the sustain voltage VSUS of the second node N22 and the low-level voltage of the third node N23.

During the compensation period B, the first power supply voltage ELVDD is changed to a high-level voltage. As the first power supply voltage ELVDD is changed to a high-level voltage, current flows through the turned-on driving transistor TR24 and the light emitting transistor TR26. The voltage of the third node N23 reset to the low-level voltage gradually rises, and the driving transistor TR24 is turned off when the voltage of the third node N23 reaches a VSUS−Vth voltage. Here, Vth denotes the threshold voltage of the driving transistor TR24. The threshold voltage Vth of the driving transistor TR24 is stored in the second capacitor C22.

During the data transmission period C, the first power supply voltage ELVDD is applied as a high-level voltage, the second power supply voltage ELVSS is applied as a low-level voltage, the scan signals S[1] to S[n] and the write signal GW are applied with the gate-on voltage, the light emission signal GE and the reset signal GR are applied with the gate-off voltage, and the data signal data[j] is applied with the sustain voltage VSUS. The light emitting transistor TR26 is turned off by the light emission signal GE having the gate-off voltage, and the reset transistor TR25 is turned off by the reset signal GR having the gate-off voltage. The switching transistor TR21 is turned on by the scan signal S[i] having the gate-on voltage, and the relay transistor TR23 is turned on by the write signal GW having the gate-on voltage. As the switching transistor TR21 and the relay transistor TR23 are turned on, the voltage stored in the first capacitor C21 is applied to the second node N22. The voltage stored in the first capacitor C21, which is stored in the first capacitor C21 in the scanning period D of the previous frame, is denoted by Vref−data. A description of which will be given later in the description of the scanning period D. Here, data denotes the voltage of data signals data[1] to data[m]. In this case, as the sustain voltage VSUS is applied to the data line Dj, a Vref−data+VSUS voltage is applied to the second node N22. The voltage Vg of the second node N22 is changed from VSUS by the amount of Vref−data+VSUS.

In this case, as the second capacitor C22 and the parasitic capacitor of the organic light emitting diode OLED are serially connected, the serially-connected capacitors affect the amount of voltage change of Vref−data+VSUS.

The voltage Vg of the second node N22 is changed as shown in Equation 1 explained in FIG. 4. The voltage Vs of the third node N23 is changed from VSUS−Vth by the amount of voltage change at the second node N22, as shown in Equation 2 explained in FIG. 4.

During the light emission period E, the light emission signal GE is applied with the gate-on voltage, and the write signal GW is applied with the gate-off voltage. The light emitting transistor TR26 is turned on by the light emission signal GE having the gate-on voltage, and drive current Ioled flows to the organic light emitting diode OLED through the driving transistor TR24. The drive current Ioled flowing to the organic light emitting diode OLED is represented as shown in Equation 3 explained in FIG. 4.

The organic light emitting diode OLED emits light with a brightness corresponding to the drive current. The organic light emitting diode OLED emits light with a brightness corresponding to the data voltage, regardless of a voltage drop in the first power supply voltage ELVDD and the threshold voltage Vth of the driving transistor TR24. When the light emission signal GE is applied with the gate-off voltage, the light emission period E is finished.

During the scanning period D, the plurality of scan signals S[1] to S[n] are sequentially applied with the gate-on voltage, and the data signal data[j] is applied corresponding to the plurality of scan signals S[1] to S[n]. In this case, the write signal GW is applied with the gate-off voltage to turn off the relay transistor TR23. The light emission signal GE is applied with the gate-on voltage to turn on the reference voltage transistor TR22. The switching transistor TR11 is turned on by the scan signal S[i] having the gate-on voltage, and the data voltage is applied to one electrode of the first capacitor C21 through the turned-on switching transistor TR21. In this case, the reference voltage Vref is applied to the first node N21 through the turned-on reference voltage transistor TR22, so that the Vref−data voltage is stored in the first capacitor C21. The Vref−data voltage stored in the first capacitor C21 is used during the light emission period E of the next frame.

As described above, the display device 10 including the pixel 30 of the second exemplary embodiment can secure sufficient data writing time because it is capable of writing data and emitting light simultaneously. Also, an operation of transmitting a data voltage to the gate electrode of the driving transistor TR24 during the data transmission period C is performed on the basis of data lines having equivalent resistance and capable of independent potential supply, thereby making it easy to achieve a stable and uniform screen display.

Figure 8:
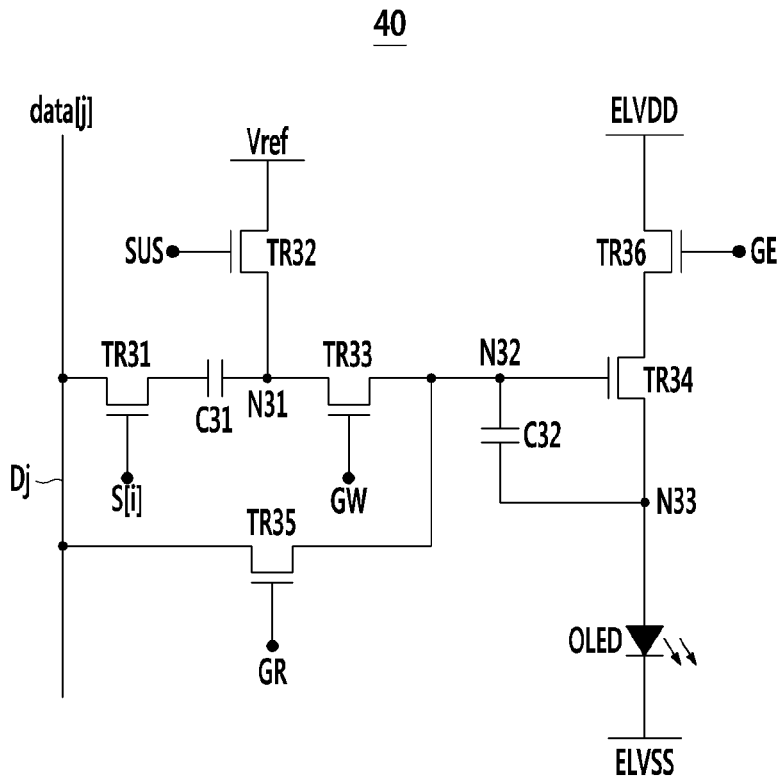
FIG. 8 is a view showing a pixel in accordance with yet another exemplary embodiment.

FIG. 8 is a view showing a pixel in accordance with yet another exemplary embodiment.

Referring to FIG. 8, a pixel 40 of a third exemplary embodiment comprises a switching transistor TR31, a reference voltage transistor TR32, a relay transistor TR33, a driving transistor TR34, a reset transistor TR35, a light emitting transistor TR36, a first capacitor C31, a second capacitor C32, and an organic light emitting diode OLED.

The pixel 40 of the third exemplary embodiment is different from the pixel 30 of the second exemplary embodiment in that the reference voltage transistor TR32 comprises a gate electrode to which a sustain signal SUS is applied, one electrode connected to a reference voltage Vref, and the other electrode connected to the first node N31. The reference voltage transistor TR32 is turned on by the sustain signal SUS having a gate-on voltage to apply the reference voltage Vref to the first node N31.

As the reference voltage transistor TR32 in the pixel 40 of the third exemplary embodiment is controlled not by the light emission signal GE but by the sustain signal SUS, the light emission period E for allowing the organic light emitting diode OLED to emit light and the scanning period D for writing data can be independently set.

The other components of the pixel 40 of the third exemplary embodiment, besides the reference voltage transistor TR32, are identical to those of the pixel 30 of the second exemplary embodiment, so a detailed description of them will be omitted.

Figure 9:
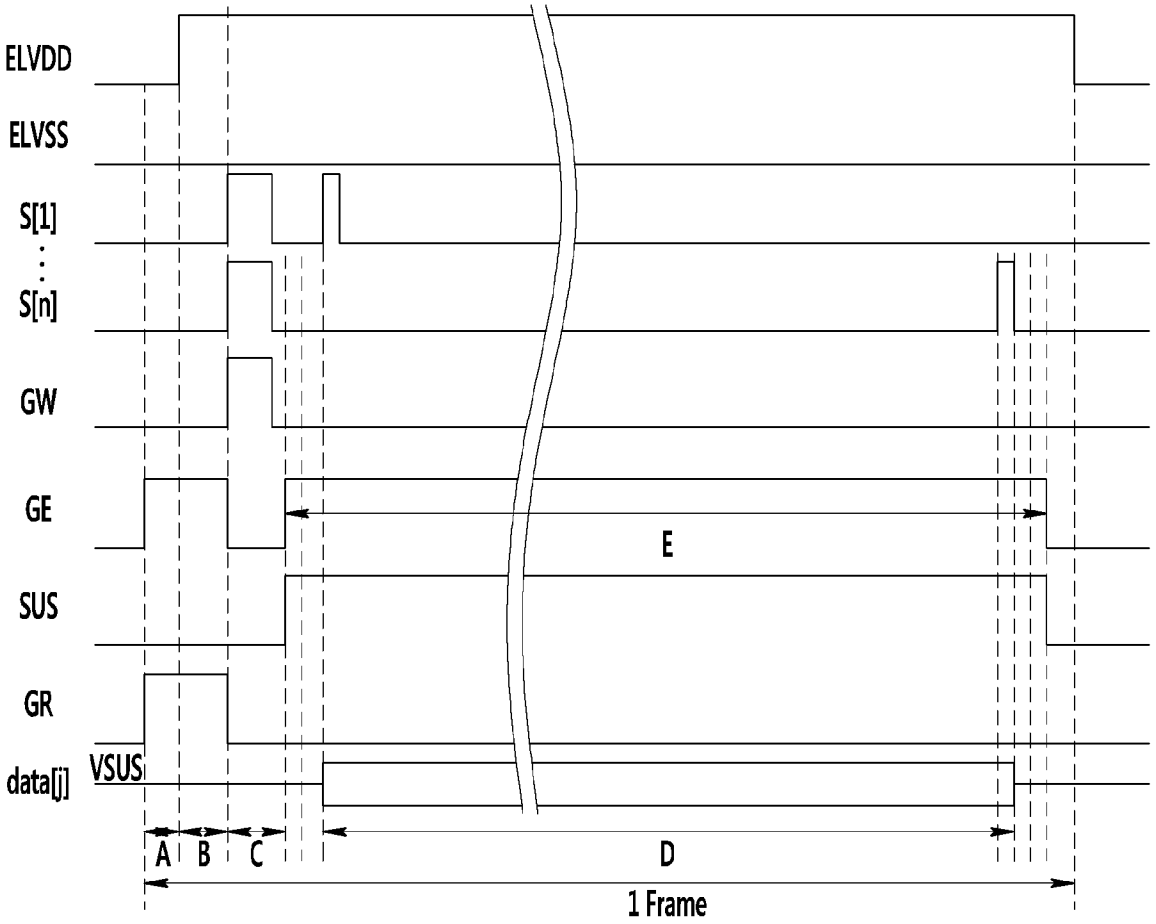
FIG. 9 is a timing diagram showing a driving method of a display device in accordance with yet another exemplary embodiment.

FIG. 9 is a timing diagram showing a driving method of a display device in accordance with yet another exemplary embodiment.

Referring to FIGS. 8 and 9, a driving method of a display device including the pixel 40 of the third exemplary embodiment will be described.

The display device including the pixel 40 of the third exemplary embodiment is different from the display device including the pixel 30 of the second exemplary embodiment in that it comprises a sustain signal unit 800 for outputting a sustain signal SUS.

The sustain signal SUS is applied with a gate-off voltage during the reset period A, compensation period B, and data transmission period C, and applied with a gate-on voltage during the scanning period D. As the scanning period D and the light emission period E temporally overlap each other, it can be said that the sustain signal SUS is applied with the gate-on voltage during the light emission period E.

During the scanning period D, the plurality of scan signals S[1] to S[n] are sequentially applied with the gate-on voltage, and the data signal data[j] is applied corresponding to the plurality of scan signals S[1] to S[n]. In this case, the write signal GW is applied with the gate-off voltage to turn off the relay transistor TR33. The sustain signal SUS is applied with the gate-on voltage to turn on the reference voltage transistor TR32. The switching transistor TR31 is turned on by the scan signal S[i] having the gate-on voltage, and the data voltage is applied to one electrode of the first capacitor C31 through the turned-on switching transistor TR31. In this case, the reference voltage Vref is applied to the first node N31 through the turned-on reference voltage transistor TR32, so that the Vref−data voltage is stored in the first capacitor C31. The Vref−data voltage stored in the first capacitor C31 is used during the light emission period E of the next frame.

The operation of the display device including the pixel 40 of the third exemplary embodiment during the reset period A, compensation period B, and light emission period E is identical to the operation of the display device including the pixel 30 of the second exemplary embodiment, so a detailed description thereof will be omitted.

If the light emission period E and the scanning period D are independently set, the length of the scanning period D can be adjusted, regardless of the light emission period E, by adjusting the period during which the sustain signal SUS is applied as the gate-on voltage. For example, the scanning period D and the light emission period E may be configured to temporally overlap not entirely but only partially, by reducing the length of time during which the sustain signal SUS is applied with the gate-on voltage.

That is, the sustain signal SUS is a signal that determines the length of the scanning period D.

Figure 10:
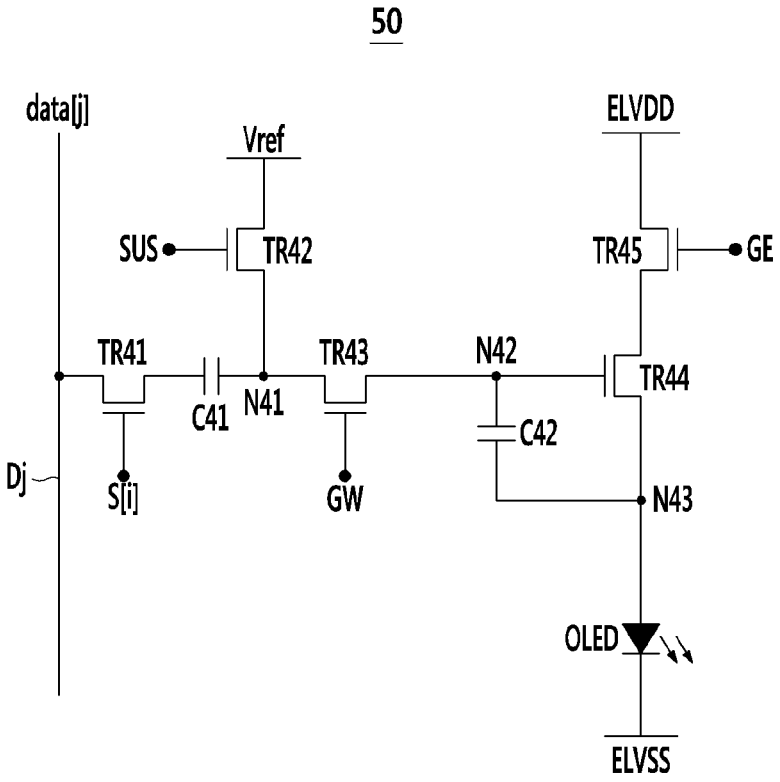
FIG. 10 is a circuit diagram showing a pixel in accordance with a further exemplary embodiment.

FIG. 10 is a circuit diagram showing a pixel in accordance with a further exemplary embodiment.

Referring to FIG. 10, a pixel 50 of a fourth exemplary embodiment comprises a switching transistor TR41, a reference voltage transistor TR42, a relay transistor TR43, a driving transistor TR44, a light emitting transistor TR45, a first capacitor C41, a second capacitor C42, and an organic light emitting diode OLED.

The pixel 50 of the fourth exemplary embodiment is different from the pixel 40 of the third exemplary embodiment in that it does not comprise a reset transistor. With the exception of the reset transistor, the other components of the pixel 50 of the fourth exemplary embodiment are identical to those of the pixel 40 of the third exemplary embodiment, so a description of them will be omitted.

Figure 11:
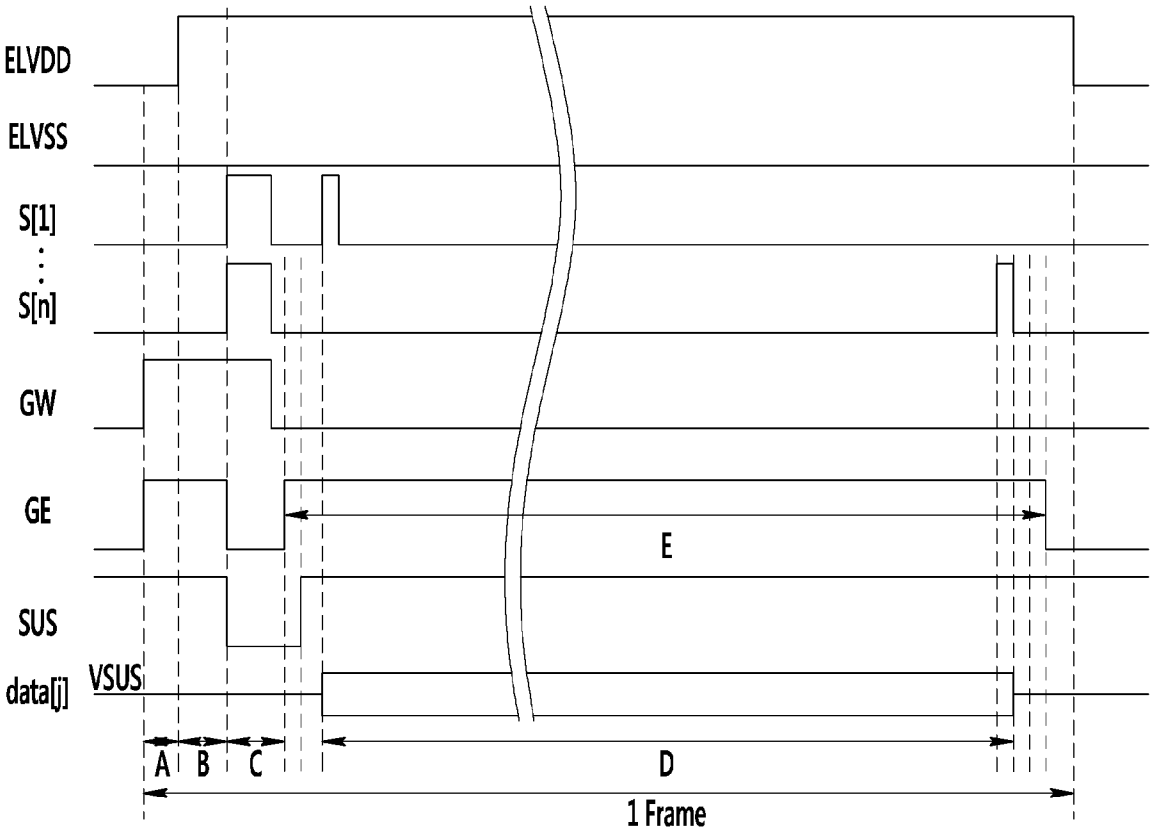
FIG. 11 is a timing diagram showing a driving method of a display device in accordance with a further exemplary embodiment.

FIG. 11 is a timing diagram showing a driving method of a display device in accordance with a further exemplary embodiment.

Referring to FIGS. 10 and 11, a driving method of a display device including the pixel 50 of the fourth exemplary embodiment will be described. The display device including the pixel 50 of the fourth exemplary embodiment may not comprise a reset signal unit 700.

During the reset period A, the first power supply voltage ELVDD and the second power supply voltage ELVSS are applied as a low-level voltage, the write signal GW, the light emission signal GE, and the sustain signal SUS are applied with the gate-on voltage, and the scan signals S[1] to S[n] are applied with the gate-off voltage. The relay transistor TR43 is turned on by the write signal GW having the gate-on voltage, the light emitting transistor TR45 is turned on by the light emission signal GE having the gate-on voltage, and the reference voltage transistor TR42 is turned on by the sustain signal SUS having the gate-on voltage. The reference voltage Vref is applied to the second node N42 through the turned-on reference voltage transistor TR42 and the turned-on relay transistor TR43. The reference voltage Vref may be a predetermined voltage enough to turn on the driving transistor TR44, and the driving transistor TR44 is turned on by the reference voltage Vref. The first power supply voltage ELVDD of the low level is applied to the third node N43 through the turned-on driving transistor TR44 and the light emitting transistor TR45. Accordingly, the voltage of the third node N43, i.e., the anode voltage of the organic light emitting diode OLED, is reset to the low-level voltage. The voltages at both ends of the second capacitor C42 are reset to the reference voltage Vref of the second node N42 and the low-level voltage of the third node N43.

During the compensation period B, the first power supply voltage ELVDD is changed to a high-level voltage. As the first power supply voltage ELVDD is changed to a high-level voltage, current flows through the turned-on driving transistor TR44 and the light emitting transistor TR45. The voltage of the third node N43 reset to the low-level voltage gradually rises, and the driving transistor TR44 is turned off when the voltage of the third node N43 reaches a Vref−Vth voltage. Here, Vth denotes the threshold voltage of the driving transistor TR44. The threshold voltage Vth of the driving transistor TR44 is stored in the second capacitor C42.

During the data transmission period C, the first power supply voltage ELVDD is applied as a high-level voltage, the second power supply voltage ELVSS is applied as a low-level voltage, the scan signals S[1] to S[n] and the write signal GW are applied with the gate-on voltage, the light emission signal GE and the sustain signal SUS are applied with the gate-off voltage, and the data signal data[j] is applied with the sustain voltage VSUS. The light emitting transistor TR45 is turned off by the light emission signal GE having the gate-off voltage, and the reference voltage transistor TR42 is turned off by the sustain signal SUS having the gate-off voltage. The switching transistor TR41 is turned on by the scan signal S[i] having the gate-on voltage, and the relay transistor TR43 is turned on by the write signal GW having the gate-on voltage. As the switching transistor TR41 and the relay transistor TR43 are turned on, the voltage stored in the first capacitor C41 is applied to the second node N42. The voltage stored in the first capacitor C41, which is stored in the first capacitor C41 in the scanning period D of the previous frame, is denoted by Vref−data. A description of which will be given later in the description of the scanning period D. Here, data denotes the voltage of data signals data[1] to data[m]. In this case, as the sustain voltage VSUS is applied to the data line Dj, a Vref−data+VSUS voltage is applied to the second node N42. The voltage Vg of the second node N42 is changed from VSUS by the amount of Vref−data+VSUS.

In this case, as the second capacitor C42 and the parasitic capacitor of the organic light emitting diode OLED are serially connected, the serially-connected capacitors affect the amount of voltage change of Vref−data+VSUS. The voltage Vg of the second node N42 is changed as shown in Equation 1 explained in FIG. 4.

$$\begin{aligned} Vg &= VSUS + (Vref - \text{data} + VSUS - Vref) \times \alpha \\ &= VSUS + (VSUS - \text{data}) \times \alpha \\ \alpha &= Chold / (Chold + Cx) \\ Cx &= (Coled \times Cst) / (Coled + Cst) \end{aligned} \quad \text{(Equation 4)}$$

where Chold denotes the capacitance of the first capacitor C41, Cst denotes the capacitance of the second capacitor C42, and Coled denotes the parasitic capacitance of the organic light emitting diode OLED.

The voltage Vs of the third node N43 is changed from Vref−Vth by the amount of voltage change at the second node N42, as shown in Equation 5.

$$Vs = Vref - Vth + (Vref - \text{data}) \times \alpha \times (Cst/(Cst + Coled)) \quad \text{(Equation 5)}$$

During the light emission period E, the light emission signal GE and the sustain signal SUS are applied with the gate-on voltage, and the write signal GW is applied with the gate-off voltage. The light emitting transistor TR45 is turned on by the light emission signal GE having the gate-on voltage, and drive current Ioled flows to the organic light emitting diode OLED through the driving transistor TR44. The drive current Ioled flowing to the organic light emitting diode OLED is represented as shown in Equation 6.

$$\begin{aligned} Ioled &= k(Vgs - Vth)^2 \\ &= k[(VSUS + (VSUS - \text{data}) \times \alpha) - (Vref - Vth + (Vref - \text{data}) \times \alpha \times (Cst / (Cst \mid Coled))) - Vth]^2 \\ &= k[(VSUS - Vref + \alpha(VSUS - \text{data} - (Vref - \text{data}) \times (Cst / (Cst + Coled)))]^2 \end{aligned} \quad \text{(Equation 6)}$$

where k is a parameter determined by the characteristics of the driving transistor TR44. Assuming that the reference voltage Vref and the sustain voltage VSUS are equal, the same result as in Equation 3 explained in FIG. 4 is obtained from Equation 6.

As such, the organic light emitting diode OLED emits light with a brightness corresponding to the drive current Ioled flowing through the driving transistor TR44 by the voltage stored in the second capacitor C42. The organic light emitting diode OLED emits light with a brightness corresponding to the data voltage, regardless of a voltage drop in the first power supply voltage ELVDD and the threshold voltage Vth of the driving transistor TR44. When the light emission signal GE is applied with the gate-off voltage, the light emission period E is finished.

During the scanning period D, the plurality of scan signals S[1] to S[n] are sequentially applied with the gate-on voltage, and the data signal data[j] is applied corresponding to the plurality of scan signals S[1] to S[n]. In this case, the write signal GW is applied with the gate-off voltage to turn off the relay transistor TR23. The sustain signal SUS is applied with the gate-on voltage to turn on the reference voltage transistor TR42. The switching transistor TR41 is turned on by the scan signal S[i] having the gate-on voltage, and the data voltage is applied to one electrode of the first capacitor C41 through the turned-on switching transistor TR41. In this case, the reference voltage Vref is applied to the first node N41 through the turned-on reference voltage transistor TR42, so that the Vref−data voltage is stored in the first capacitor C41. The Vref−data voltage stored in the first capacitor C41 is used during the light emission period E of the next frame.

As described above, the display device 10 including the pixel 50 of the fourth exemplary embodiment can secure sufficient data writing time because it is capable of writing data and emitting light simultaneously. Also, an operation of transmitting a data voltage to the gate electrode of the driving transistor TR44 during the data transmission period C is performed on the basis of data lines having equivalent resistance and capable of independent potential supply, thereby making it easy to achieve a stable and uniform screen display.

Moreover, the proposed pixel is suitable for large-sized and high-resolution display panels because it can secure sufficient data writing time by writing data and emitting light simultaneously, and can secure a sufficient aperture ratio by using two capacitors.

Meanwhile, in the pixels 20, 30, 40, and 50 of the above-described first, second, third, and fourth exemplary embodiments, an organic emission layer of the organic light emitting diode OLED may be made of a low-molecular organic material or a high-molecular organic material, such as PEDOT (Poly 3,4-ethylenedioxythiophene). Moreover, the organic emission layer may be formed as multilayers including at least one of a hole injection layer HIL, a hole transporting layer HTL, an electron transporting layer ETL, and an electron injection layer EIL. If all these are included, the hole injection layer is disposed on the pixel electrode which is a positive electrode, and the hole transporting layer, the light emission layer, the electron transporting layer, and the electron injection layer are sequentially stacked on the hole injection layer.

The organic emission layer may comprise a red organic emission layer for emitting red light, a green organic emission layer for emitting green light, and a blue organic emission layer for emitting blue light, and the red organic emission layer, the green organic emission layer, and the blue organic emission layer are respectively formed on a red pixel, a green pixel, and a blue pixel, thereby representing a color image.

Also, the organic emission layer can represent a color image by stacking the red organic emission layer, green organic emission layer, and blue organic emission layer on the red, green, and blue pixels, and forming red, green, and blue color filters in the respective pixels. In another example, a color image may be represented by forming a white organic emission layer for emitting white light on the red, green, and blue pixels, and forming red, green, and blue color filters in the respective pixels. When representing a color image by using the white organic emission layer and the color filters, there is no need to use a deposition mask to deposit the red organic emission layer, green organic emission layer, and blue organic emission layer in the respective pixels: the red, green, and blue pixels.

The white organic emission layer explained in another example may be formed as a single organic emission layer, or may consist of a plurality of organic emission layers stacked to emit white light. For example, at least one yellow organic emission layer and at least one blue organic emission layer may be combined to emit white light, at least one cyan organic emission layer and at least one red organic emission layer may be combined to emit white light, or at least one magenta organic emission layer and at least one green organic emission layer may be combined to emit white light.

Moreover, at least one of the plurality of transistors in each of the pixels 20, 30, 40, and 50 of the above-described first, second, third, and fourth exemplary embodiments may be an oxide thin film transistor (oxide TFT) whose semiconductor layer is made of oxide semiconductor.

The oxide semiconductor may comprise at least one of the group consisting of titanium (Ti)-, hafnium (Hf)-, zirconium (Zr)-, aluminum (Al)-, tantalum (Ta)-, germanium (Ge)-, zinc (Zn)-, gallium (Ga)-, tin (Sn)-, and indium (In)-based oxides, and composite oxides thereof, such as zinc oxide (ZnO), indium-gallium-zinc oxide (InGaZnO4), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O).

The semiconductor layer may comprise a channel region not doped with an impurity, and a source region and a drain region formed at both sides of the channel region, and doped with an impurity. Such an impurity differs according to the type of thin film transistor, and may comprise an N-type impurity or P-type impurity.

If the semiconductor layer is made of oxide semiconductor, a protective layer may be added to protect the oxide semiconductor weak to the outside environment, such as exposure to high temperature.

While exemplary embodiments of the present invention have been particularly shown and described with reference to the accompanying drawings, the specific terms used herein are used for the purpose of describing the invention and are not intended to define the meanings thereof or be limiting of the scope of the invention set forth in the claims. Therefore, those skilled in the art will understand that various modifications and equivalent other embodiments of the present invention are possible. Consequently, the true technical protective scope of the present invention must be determined based on the technical spirit of the appended claims.

What is claimed is:

1. A display device comprising a plurality of pixels, each pixel comprising:

a first capacitor connected between a data line and a first node;

a reference voltage transistor configured to apply a reference voltage on the first node;

a driving transistor having a gate connected to a second node and configured to control a drive current flowing from a first power supply voltage to an organic light emitting diode in response to a voltage of the second node applied to the gate of the driving transistor;

a light emitting transistor configured to apply the first power supply voltage to an electrode of the driving transistor in response to a light emission signal applied to a gate of the light emitting transistor;

a second capacitor connected between the second node and an anode of the organic light emitting diode; and a relay transistor configured to electrically connect the first node and the second node in response to a write signal applied to a gate of the relay transistor, wherein during a light emission period, the organic light emitting diode is configured to emit an intensity of light based at least in part on a drive current flowing through the driving transistor, the drive current of the driving transistor determined at least in part by a voltage stored in the second capacitor, wherein during a scanning period, the relay transistor is configured to be turned off and the reference voltage transistor is configured to be turned on to apply the reference voltage on the first node, such that a data voltage is stored in the first capacitor, the data voltage determined at least in part by an amount of current flowing through the reference transistor, and wherein when the plurality of pixels are simultaneously in the light emission period, the reference voltage transistor is configured to be turned on by a scan signal applied to a gate of the reference voltage transistor.

2. The display device of claim 1, wherein the each pixel further comprises a reset transistor comprising:

a gate configured to receive a reset signal;

a first electrode connected to the data line; and a second electrode connected to the second node.

3. The display device of claim 2, wherein the reference voltage transistor is configured to apply a reference voltage to the first node in response to a scan signal applied to the gate of the reference voltage transistor, and wherein the reference voltage transistor further comprises:

a first electrode configured to receive the reference voltage; and a second electrode connected to the first node.

4. The display device of claim 2, wherein the each pixel further comprises a switching transistor comprising:

a gate configured to receive a scan signal;

a first electrode connected to the data line; and a second electrode connected to the first capacitor.

5. The display device of claim 4, wherein during the light emission period, the reference voltage transistor and the light emission transistor are configured to be turned on at least in part by the light emission signal applied to the gates of the reference voltage transistor and the light emission transistor, and the switching transistor is configured to be turned on by the scan signal applied to the gate of the switching transistor.

6. The display device of claim 4, wherein during the light emission period, the reference voltage transistor is turned on by a sustain signal, and the switching transistor is turned on by the scan signal.

7. The display device of claim 1, wherein the each pixel further comprises a switching transistor comprising:

a gate configured to receive a scan signal;

a first electrode connected to the data line; and a second electrode connected to the first capacitor, wherein during the light emission period, the reference voltage transistor is configured to be turned on by a sustain signal applied to the gate of the reference voltage transistor, and the switching transistor is configured to be turned on by a scan signal applied to the gate of the switching transistor.

8. A driving method of a display comprising a plurality of pixels, comprising:

scanning the pixels during a scanning period of a first frame, comprising:

turning off a relay transistor, the relay transistor configured to electrically connect a first node and a second node in response to a write signal applied to a gate of the relay transistor;

turning on a reference voltage transistor to apply a reference voltage to the first node; and storing a data voltage in a first capacitor connected between a data line and the first node, the data voltage determined at least in part by an amount of current flowing through the reference transistor;

emitting light from the pixels during a light emission period of the first frame, including:

turning on a driving transistor, the driving transistor having a gate connected to the second node and configured to control a drive current flowing from a first power supply voltage to an organic light emitting diode in response to a voltage of the second node applied to the gate of the driving transistor; and turning on a light emitting transistor during the light emission period by applying a light emission signal to a gate of the light emitting transistor, and allowing the organic light emitting diode to emit light whose intensity is based at least in part on a drive current of the driving transistor determined at least in part by a voltage stored in a second capacitor connected between the second node and an anode of the organic light emitting diode, wherein the voltage stored in the second capacitor is equal to the voltage stored in the first capacitor in the scanning period of the frame preceding the first frame, and the scanning period and the light emission period at least temporally overlap each other.

9. The method of claim 8, wherein emitting light includes emitting light simultaneously from the pixels.

10. The method of claim 8, wherein scanning further comprises turning on the reference voltage transistor by applying a scan signal to a gate of the reference voltage transistor.

11. The method of claim 8, wherein scanning further comprises turning on a switching transistor to electrically connect the data line and the first capacitor by applying a scan signal to a gate of the switching transistor.

12. The method of claim 11, wherein scanning further comprises turning on the reference voltage transistor by applying a light emission signal to a gate of the light emitting transistor.

13. The method of claim 11, wherein scanning further comprises turning on the reference voltage transistor by applying a sustain signal to a gate of the light emitting transistor for determining the length of the scanning period.

14. The method of claim 8, further comprising resetting an anode voltage of the organic light emitting diode to a low-level voltage.

15. The method of claim 14, wherein resetting comprises:

turning on a reset transistor connected between the data line and the second node to apply a sustain voltage applied to the data line to the second node; and turning on the driving transistor by applying the sustain voltage to the gate of the driving transistor, turning on the light emitting transistor by applying a light emission signal to the gate of the light emitting transistor, and applying a first power supply voltage having the low-level to the anode of the organic light emitting diode.

16. The method of claim 14, wherein resetting comprises:

turning on the reference voltage transistor and the relay transistor to apply the reference voltage to the second node; and turning on the driving transistor by applying the reference voltage to the gate of the driving transistor, turning on the light emitting transistor by applying a light emission signal to the gate of the light emitting transistor, and applying a first power supply voltage having the low-level to the anode of the organic light emitting diode.

17. The method of claim 14, further comprising, after resetting the anode voltage of the organic light emitting diode, compensating the threshold voltage of the driving transistor.

18. The method of claim 17, wherein compensating comprises, when the driving transistor and the light emitting transistor are turned on, changing the first power supply voltage having the low level to a high-level voltage.

19. The method of claim 17, further comprising, after compensating the threshold voltage of the driving transistor, turning on the relay transistor, and transmitting to the second node the voltage stored in the first capacitor in the scanning period of the frame preceding the first frame.

20. The method of claim 19, wherein transmitting further comprises turning off the reference voltage transistor, and applying a predetermined sustain voltage, which is applied to the data line, to the first capacitor.

21. A display pixel comprising:

a first capacitor comprising a first electrode configured to receive a voltage of a data line and a second electrode connected to a first node;

a reference voltage transistor comprising a gate configured to receive a first control signal, a first electrode connected to a reference voltage, and a second electrode connected to the first node;

a relay transistor comprising a gate configured to receive a write signal, a first electrode connected to the first node, and a second electrode connected to a second node;

a driving transistor comprising a gate directly connected to the second node, a first electrode configured to receive a first power supply voltage, and a second electrode connected to a third node;

a light emitting transistor comprising a gate configured to receive a light emission signal, a first electrode connected to the first power supply voltage, and a second electrode connected to the first electrode of the driving transistor;

a second capacitor comprising a first electrode connected to the second node and a second electrode connected to the third node; and an organic light emitting diode comprising an anode connected to the third node and a cathode connected to a second power supply voltage, wherein during a scanning period of a frame, the second capacitor is configured to store a voltage equal to a voltage stored in the first capacitor in a scanning period of a preceding frame, and wherein a light emission period and the scanning period of the frame at least temporarily overlap each other.

22. The pixel of claim 21, further comprising a reset transistor comprising a gate configured to receive a reset signal, a first electrode connected to the data line, and a second electrode connected to the second node.

23. The pixel of claim 22, wherein the first control signal is a scan signal that is sequentially applied to a display unit comprising a plurality of pixel.

24. The pixel of claim 22, further comprising a switching transistor comprising a gate configured to receive a scan signal, a first electrode connected to the data line, and a second electrode connected to the first electrode of the first capacitor.

25. The pixel of claim 24, wherein the first control signal is a light emission signal.

26. The pixel of claim 24, wherein the first control signal is a sustain signal for determining the length of the scanning period during which the data voltage applied to the data line is stored in the first capacitor.

27. The pixel of claim 24, wherein at least one of the reference voltage transistor, the relay transistor, the driving transistor, the light emitting transistor, the reset transistor, and the switching transistor is an oxide thin film transistor.

28. The pixel of claim 21, further comprising a switching transistor comprising a gate configured to receive a scan signal, a first electrode connected to the data line, and a second electrode connected to the first electrode of the first capacitor.

29. The pixel of claim 28, wherein the first control signal is a sustain signal for determining the length of the scanning period during which the data voltage applied to the data line is stored in the first capacitor.

* * * * *